US006619843B2

(12) United States Patent
Harmanoglu

(10) Patent No.: US 6,619,843 B2
(45) Date of Patent: Sep. 16, 2003

(54) BANK DEPOSIT PLASTIC BAG

(76) Inventor: Hikmet Harmanoglu, 179 Morgan Ave., Brooklyn, NY (US) 11237

( * ) Notice: Subject to any disclaimer, the term of this patent is extended or adjusted under 35 U.S.C. 154(b) by 87 days.

(21) Appl. No.: 09/761,077

(22) Filed: Jan. 17, 2001

(65) Prior Publication Data

US 2001/0005435 A1 Jun. 28, 2001

Related U.S. Application Data

(63) Continuation of application No. 09/157,676, filed on Sep. 21, 1998, now abandoned.

(51) Int. Cl.[7] ..... B65D 33/24
(52) U.S. Cl. ..... 383/84; 383/38; 229/70; 229/72
(58) Field of Search ..... 383/84, 38, 5, 383/39, 40; 229/70, 72, 69

(56) References Cited

U.S. PATENT DOCUMENTS 2,840,295 A * 6/1958 Fromm ..... 229/70
3,866,822 A * 2/1975 Faltin et al. ..... 229/69
4,483,018 A * 11/1984 Whelan ..... 383/5
4,712,729 A * 12/1987 Craig ..... 383/5 X
4,720,040 A * 1/1988 Gurewitz ..... 383/5 X
4,733,817 A * 3/1988 Makowka ..... 229/69
4,988,547 A * 1/1991 Voto, Jr. et al. ..... 383/84 X
5,478,010 A * 12/1995 Vaucher ..... 229/80

* cited by examiner

*Primary Examiner*—Jes F. Pascua
(74) *Attorney, Agent, or Firm*—Myron Amer P.C.

(57) ABSTRACT

A bank deposit plastic bag made with two separable compartments, one for checks identifying the depositor, and the other for cash using as an insert a depositor-identifying flap, in the manufacture of which different heat seals, strategically located lines of perforations and an adhesive deposit cooperate to accommodate a range of banking needs of the user, characterized by the use of components and parts of the bag, as exemplified by the noted depositor-identifying flap, and adhesively sealable closure flaps for the two compartments.

1 Claim, 2 Drawing Sheets

BANK DEPOSIT PLASTIC BAG

This is a continuation of application Ser. No. 09/157,676 filed Sep. 21, 1998 now abandoned.

The present invention relates generally to a plastic bag whose construction, including heat seals and lines of perforations, facilitates its use for bank deposits.

EXAMPLE OF THE PRIOR ART

It is already well-known, as exemplified by U.S. Pat. No. 2,735,797 issued to G. T. Schjeldahl for "Method of Heat Sealing and Severing Plastic Sheets" on Dec. 1, 1952, that sheets of plastic construction material are amenable to heat sealing or fusion thus enabling techniques to be employed in fabricating useful articles of manufacture such as, for example, as applied to plastic bag manufacture, line seals useful in forming side edges of bags, a seal with width or bar seal, useful in forming a strong bond between superposed panels of the bags, or lines of perforations, useful in separating a series of bags at the location coinciding with the line of perforations.

Using the aforesaid techniques alone or in combination a great variety of plastic bags have been fabricated, to mention but a few, the "Stand-Up Plastic Bag and Method of Making Same" of U.S. Pat. No. 4,837,849 issued to Erickson et al. on Jun. 6, 1989, the "Rib and Groove Closure Bag with Bead Sealed Sides" of U.S. Pat. No. 4,658,433 issued to Alan F. Savicki on Apr. 14, 1987, and "Packages" of U.S. Pat. No. 3,204,760 issued to C. L. Whiteford on Sep. 7, 1965.

Heretofore, using the available techniques noted, there has not been devised a plastic bag that embodies unique product attributes enabling its use for making bank deposits. Instead, bags for this end use are of leather or cloth construction material, and typically are reused rather than being of a disposable nature, it presumably being believed, that security and other requirements of use disqualify use of a disposable plastic bag for the processing of currency, and/or checks or like commercial documentation.

Broadly, it is an object of the present invention to provide a plastic bag for making bank deposits, at minimal expense permitting disposal after use, overcoming the foregoing and other shortcomings of the prior art.

More specifically, it is an object to provide a plastic bag article of manufacture which for both the user and for bank personnel facilitates the processing of currency and checks, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
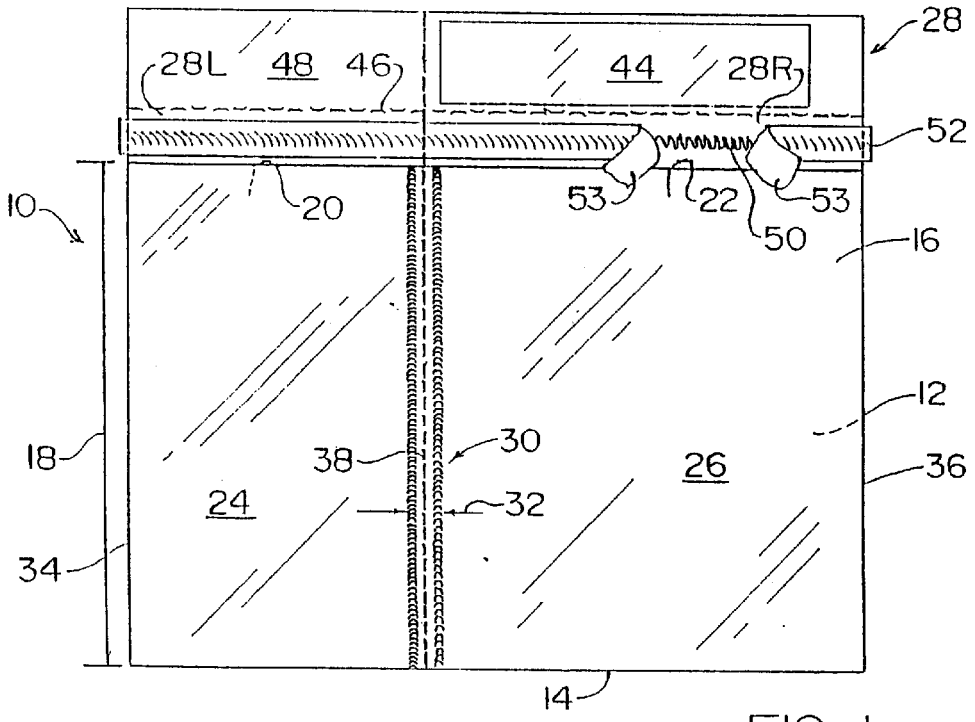
FIG. 1 is a front elevational view of a plastic bank deposit bag of the present invention.

The within inventive article of manufacture is in the specific form of a plastic bank deposit bag, generally designated 10, having a rear plastic panel 12 which is folded upon itself along a bottom fold line 14 so as to provide an overlying front panel 16 which extends only the extent 18.

As such, there are openings 20 and 22 into left and right bag compartments 24 and 26, and extending above the openings 24, 26 there is an uncovered upper strip 28 in the rear panel 12.

Figure 4:
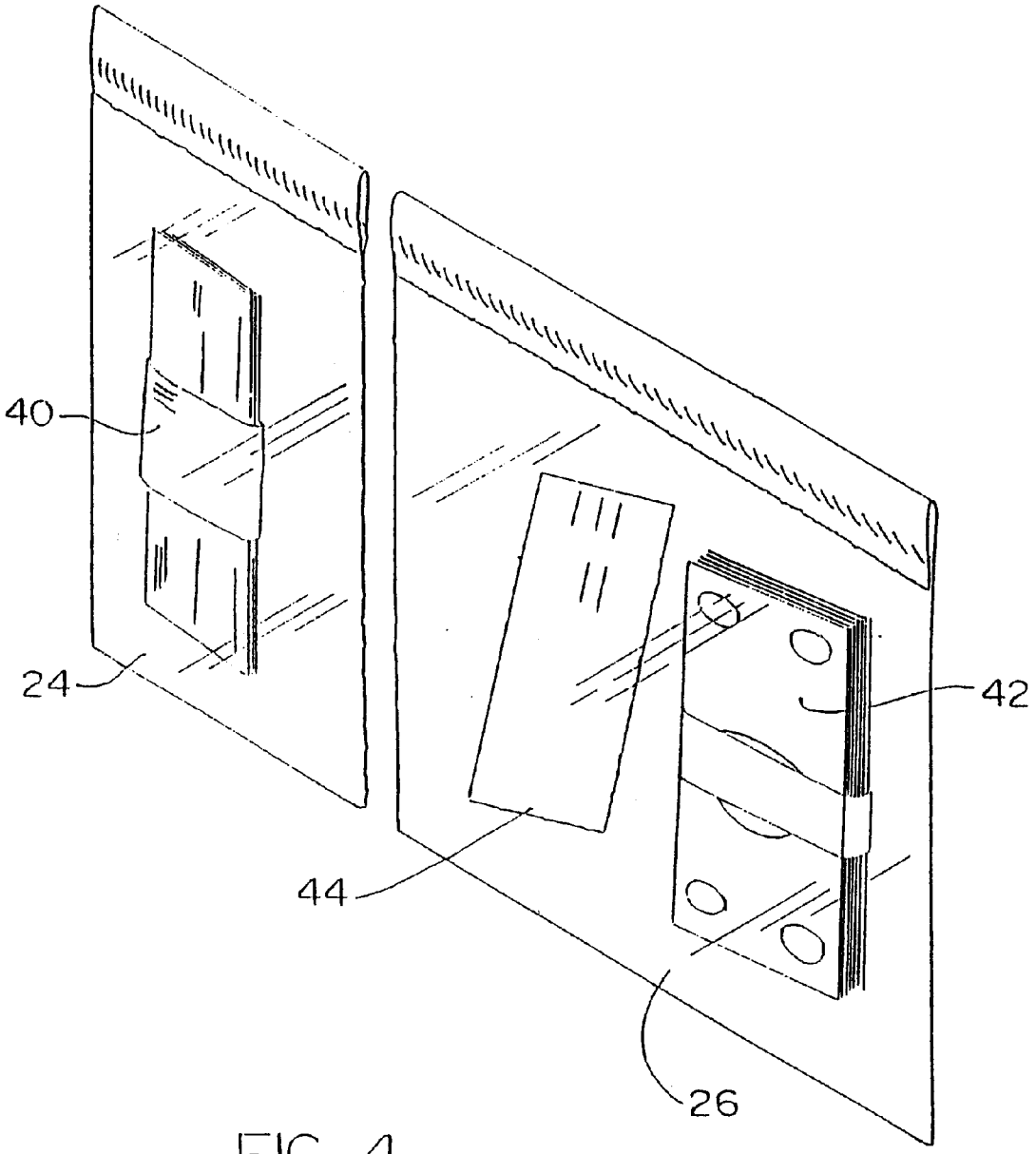
FIG. 4 is a perspective view of both bag compartments separated from each other.

The patentable advance of the bag 10 more particularly resides in an embodied vertically oriented bar seal 30 of a selected width 32, preferably ½ inch, at an offset location widthwise of bag 10 as illustrated, and which is intermediate conventional opposite side seals 34 and 36. Centrally of the bar seal 30 is a line of perforations 38 along which the bag compartments 24 and 26 are adapted to be separated from each other, as best understood from FIG. 4, so that according to recommendation the smaller bag compartment 24 can be used for checks or similar content 40 having identification of the depositor, and the larger sized bag compartment 26 for cash deposits, as at 42, requiring an inserted label 44 or the like identifying the depositor.

Figure 2:
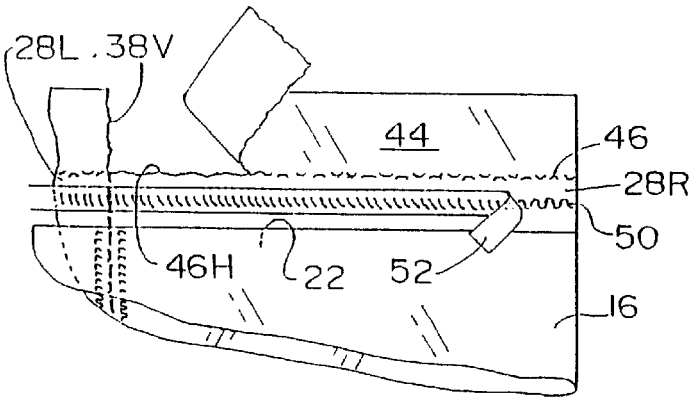
FIG. 2 is a partial view of the right hand corner of the bag as illustrated in FIG. 1, showing further structural details.
Figure 3:
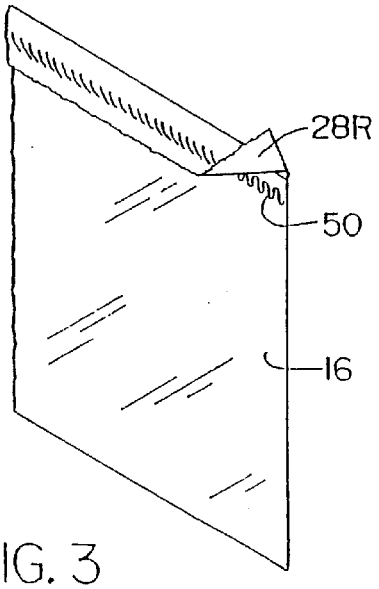
FIG. 3 is an isolated perspective view of one of the two bag compartments of the bag of FIG. 1.

The label 44 is readily available for insertion in the bag compartment 26 because of a second horizontal line of perforations 46 in the upper strip 28, enabling removal of label 44 along the vertical length portion 38V and along the horizontal length portion 46H (FIG. 2). The removal of label 44 and also the rectangular patch 48, which is merely to be discarded, prepares the portion of upper strip 28 below the line of perforations 46 and above the openings 20, 22, specifically designated 28L and 28R as closure flaps for the bag compartments 24 and 26. To this end, immediately above the openings 20 and 22 there is deposited, in a well-known manner, a linear adhesive mass 50 covered by a release strip 52 to obviate a premature adhesive attachment, as best understood from FIG. 1 showing the adhesive mass 50 beneath disconnected ends 53 of the strip 52.

In summary, the recommended use of the bag 10 contemplates insertion of checks 40 in the smaller bag 24, the insertion of cash 42 and the identifying label 44, after its removal as shown in FIG. 2, into the larger bag 26, the removal of the release strip 52 exposing the adhesive deposit 50, and the folding over the openings 20 and 22 using the closure flaps 28L and 28R to complete an adhesive attachment between the adhesive 50 and the areas of the front panel 16 beneath the openings 20, 22. Optionally, the user can then deposit the bag 10 with its sealed contents in an appropriate bank repository still connected along the lower length portion of the vertical line of perforations 38, or as separated bags 24 and 26, performing this separation for bank personnel.

While the plastic bag herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of making a manual after banking hours bank deposit as a substitution for a mail deposit vulnerable to loss during transit comprising the steps of:

A. using a bag of plastic material
   1. having a rear panel and
   2. having a front panel B. folding said front panel upwardly over said rear panel to a selected extent delineating an uncovered upper strip along a top of said rear panel C. heat sealing said front and rear panels to each other from opposite sides of said bag D. heat sealing a vertically orientated bar seal of a selected width at a selected location intermediate said opposite sealed sides delineating on one side of said bar seal a first bag compartment having an opening thereinto and on an opposite side thereof a second bag compartment having an opening thereinto E. inserting a check bank deposit into said first bag compartment and a cash bank deposit into said second bag compartment F. applying a line of perforations within said bar seal G. separating said first and second bag compartments from each other H. depositing an adhesive with a removable strip thereover horizontally along a bottom of said openings into said first and second bag compartments I. removing said strip so as to expose said adhesive deposit preparatory to the use thereof for closing said openings into said first and second bag compartments J. applying a line of perforations horizontally adjacent an upper edge of said adhesive deposit so as to delineate a removable length portion of said upper strip K. removing said delineated length portion along said line of perforations L. inscribing an identification of a bank depositor on said removed length portion M. inserting said bank depositor-identified length portion into said second bag compartment in an interposed position between said rear panel and said front panel to serve as identification of a bank depositor to be credited with said bank cash deposit in said second bag compartment N. folding over said upper strip of said top of said rear panel into adhesive contact with said adhesive to complete a containment therein of said identification of the cash deposit to be credited to said bank depositor and O. manually depositing said second bag compartment in a night bank repository whereby said high security afforded by said bank repository is substituted for the lesser security of mail transmission along with facilitated processing of said bank transaction as afforded by said inserted bank depositor identification in said second bag compartment.

* * * * *